US010121427B2

(12) United States Patent
You et al.

(10) Patent No.: US 10,121,427 B2
(45) Date of Patent: Nov. 6, 2018

(54) LIQUID CRYSTAL DISPLAY DEVICE HAVING AN OVERDRIVING DATA GENERATOR AND METHOD OF DRIVING THE SAME

(75) Inventors: Tae-Ho You, Incheon (KR); Yong-Sung Ham, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 1719 days.

(21) Appl. No.: 11/513,458

(22) Filed: Aug. 31, 2006

(65) Prior Publication Data

US 2007/0046602 A1 Mar. 1, 2007

(30) Foreign Application Priority Data

Aug. 31, 2005 (KR) ..... 10-2005-0080707

(51) Int. Cl.
*G09G 3/36* (2006.01)
*G09G 3/20* (2006.01)

(52) U.S. Cl.
CPC ..... *G09G 3/3648* (2013.01); *G09G 3/2051* (2013.01); *G09G 2320/0252* (2013.01); *G09G 2320/0261* (2013.01); *G09G 2340/16* (2013.01)

(58) Field of Classification Search
CPC ..... G09G 3/3648
USPC ..... 345/87–89, 55, 204
See application file for complete search history.

(56) References Cited

U.S. PATENT DOCUMENTS 4,591,848 A * 5/1986 Morozumi ..... H04N 3/127 345/3.1
6,362,803 B1 * 3/2002 Tomomura et al. ..... 345/94
7,277,092 B2 * 10/2007 Shen ..... G09G 3/3659 345/204
7,382,349 B1 * 6/2008 Kuhns ..... G09G 3/3685 345/102
2004/0140985 A1 * 7/2004 Liaw ..... G09G 3/3696 345/690
2005/0190610 A1 * 9/2005 Furukawa et al. ..... 365/189.05

FOREIGN PATENT DOCUMENTS

EP 1 411 492 A1 4/2004
JP 2002-062850 2/2002
JP 2002-351409 12/2002
(Continued)

OTHER PUBLICATIONS

Office Action issued in corresponding Japanese Patent Application No. 2006-233266; dated Mar. 23, 2010.
(Continued)

*Primary Examiner* — William Boddie
*Assistant Examiner* — Andrew Schnirel
(74) *Attorney, Agent, or Firm* — Seed Intellectual Property Law Group LLP

(57) ABSTRACT

A liquid crystal display device is provided. The liquid crystal display device includes an over driving data generator that compares a gray level of a data signal of a present frame with a gray level of a data signal of a previous frame to output an over driving data signal. The data signal has a bit number of n. A data drive IC generates level voltages having a number of more than $2^n$ and outputs one of the level voltages of the over driving data signal. A liquid crystal panel includes a pixel applied with the one of the level voltages.

9 Claims, 4 Drawing Sheets

(56) References Cited

FOREIGN PATENT DOCUMENTS

| | | |
|---|---|---|
| JP | 2002-366112 | 12/2002 |
| JP | 2004-310113 | 11/2004 |
| TW | 517494 | 1/2003 |
| TW | 200514005 | 4/2005 |

OTHER PUBLICATIONS

Office Action issued in corresponding German Patent Application No. 10 2006 040 559.5; dated Sep. 14, 2009.
Office Action issued in corresponding Taiwan Patent Application No. 095131798, dated May 24, 2011.
Office Action issued in corresponding Japanese Patent Application No. 2006-233266, dated Jul. 22, 2011.

* cited by examiner

LIQUID CRYSTAL DISPLAY DEVICE HAVING AN OVERDRIVING DATA GENERATOR AND METHOD OF DRIVING THE SAME

This application claims the benefit of Korean Patent Application No. 10-2005-080707, filed in Korea on Aug. 31, 2005, which is hereby incorporated by reference in its entirety.

BACKGROUND

Field

The present embodiments relate to a liquid crystal display device.

Related Art

Until recently, cathode-ray tubes (CRTs) have been typical used in display devices. Researchers are currently studying and developing various types of flat panel displays, such as liquid crystal display (LCD) devices, plasma display panels (PDPs), field emission displays (FED), and electroluminescence displays (ELDs), as a substitute for CRTs. These types of flat panel displays are driven in an active matrix type display, which has a plurality of pixels arranged in a matrix form. The plurality of pixels are driven using a plurality of thin film transistors therein. Among the active matrix types of flat panel displays, liquid crystal display (LCD) devices and electroluminescent display (ELD) devices are widely used for notebook computers and desktop computers because of their high resolution, ability to display colors and superiority in displaying moving images.

Conventionally, an LCD device includes two substrates that are spaced apart and face each other with a layer of liquid crystal molecules interposed between the two substrates. The two substrates include electrodes that face each other. A voltage applied between the electrodes induces an electric field across the layer of liquid crystal molecules. Alignment of the liquid crystal molecules changes in accordance with the intensity of the induced electric field in the direction of the induced electric field, thereby changing the light transmissivity of the LCD device. Thus, the LCD device displays images by varying the intensity of the induced electric field across the layer of liquid crystal molecules.

As shown in FIG. 1, a liquid crystal panel 100 according to the related art includes a plurality of gate lines GL1 to GLn and a plurality of data lines DL1 to DLm that cross each other to define a plurality of pixels P. Each pixel P includes a thin film transistor T, a liquid crystal capacitor Clc and a storage capacitor Cst. The liquid crystal capacitor Clc includes a pixel electrode, a common electrode and a liquid crystal layer between the pixel and common electrodes.

A data driver 110 supplies data voltages to the data lines DL1 to DLm. A gate driver 120 supplies gate voltages to the gate lines GL1 to GLn. A timing controller 130 supplies control signals to the data and gate drivers 110 and 120 and data signals to the data driver 110.

When an on gate voltage is applied to the gate line GL1 to GLn, the thin film transistor T connected to the gate line GL1 to GLn is turned on. When the thin film transistor T is turned on, the data voltage is applied to the pixel electrode of the pixel P through the data line DL1 to DLm and charged in the pixel P. A common voltage is applied to the common electrode. Accordingly, an electric field is induced to the liquid crystal and light transmissivity of the liquid crystal layer is changed, thereby displaying an image.

The liquid crystal has response delay. A pixel voltage charged in the pixel does not reach the data voltage applied, for example, a normal voltage displaying an image desired, during a charging period (frame period). Accordingly, the related art LCD device has problem of motion blurring.

Generally, an over driving method has been used to obviate the problem of motion blurring. The over driving method applies an over driving data voltage other than a data voltage corresponding to a data signal of a present frame. A data signal of the present frame is compared with a data signal of a previous frame. An over driving data voltage has a gray level higher than a data voltage of a data signal of the present frame when the data signal of the present frame has a gray level higher than the data signal of the previous frame. An over driving data voltage has a gray level lower than a data voltage of the data signal of the present frame when the data signal of the present frame has a gray level lower the data signal of the previous frame. Since the pixel is applied with the over driving data voltage higher or lower than the data voltage of the present frame, the response delay of the liquid crystal is compensated and a normal voltage desired to the pixel is reached in a frame period.

FIG. 2 is a waveform illustrating the over driving method of the related art LCD. FIG. 2(*a*) illustrates a pixel voltage charged in a pixel before adopting the over driving method, and FIG. 2(*b*) shows a pixel voltage charged in a pixel after adopting the over driving method.

As shown in FIG. 2(*a*), when the over driving method is not adopted, a data voltage 210, which is the same as a normal voltage, is applied to a pixel, and a pixel voltage charged in the pixel does not reach the normal voltage in a frame period Ts due to the response delay of the liquid crystal. As shown in FIG. 2(*b*), when the over driving method is adopted, an over driving data voltage 220, which is higher than the normal voltage, is applied to a pixel, and a pixel voltage charged in the pixel reaches the normal voltage in the frame period Ts.

When the data signal is an n-bit signal, $2^n$ gray levels are displayed. Accordingly, the data driver use an n-bit data drive IC generating $2^n$ gray level voltages corresponding to the $2^n$ gray levels, for example, respectively.

When the LCD device having the n-bit data drive IC is operated in the over driving method, the $2^n$ gray level voltages are also used for the over driving voltages.

When the n-bit data drive IC is used for the over driving method of the n-bit data signal, the over driving method can be performed for the middle gray levels.

For the highest gray level or the lowest gray level, for example, full bright gray level or full dark gray level, the over driving method can not be performed, because there is no over driving data voltages for the full bright or full dark gray level. For example, for the 9-bit data signal, 512 gray level voltages are generated. Since a $1^{st}$ gray level or $512^{th}$ gray level is a lowest or highest gray level, there is no over driving data voltages for the gray levels in the 512 gray level voltages. Accordingly, the over driving for the full bright or bull dark gray level can not be performed, and display quality is degraded.

SUMMARY

The present embodiments relate to a liquid crystal display device and a method of driving the same. The present embodiments may obviate one or more of the problems due to limitations and disadvantages of the related art. For example, in one exemplary embodiment of the liquid crystal display device and method of driving the same the display quality is improved.

Additional features and advantages of the present embodiments will be set forth in the description which follows, and in part will be apparent from the description, or may be learned by practice. Additional objectives and other advantages of the embodiments will be realized and attained by the structure particularly pointed out in the written description and claims hereof as well as the appended drawings.

A liquid crystal display device according to one exemplary embodiment includes an over driving data generator that compares a gray level of a data signal of a present frame with a gray level of a data signal of a previous frame and outputs an over driving data signal, wherein the data signal has a bit number of n. A data drive IC generates level voltages having a number of more than $2^n$ and outputs one of the level voltages of the over driving data signal. A liquid crystal panel includes a pixel applied with the one of the level voltages.

In another embodiment, a method of driving a liquid crystal display device includes comparing a gray level of a data signal of a present frame with a gray level of a data signal of a previous frame and outputting an over driving data signal, wherein the data signal has a bit number of n; generating level voltages having a number of more than $2^n$; outputting one of the level voltages corresponding to the over driving data signal; and applying the one of the level voltages to a pixel of a liquid crystal panel.

It is to be understood that both the foregoing general description and the following detailed description are exemplary and explanatory and are intended to provide further explanation of the claimed embodiments.

BRIEF DESCRIPTION OF THE DRAWINGS

The accompanying drawings, which are included to provide a further understanding of the claimed embodiments and are incorporated in and constitute a part of this specification, illustrate embodiments of the invention and together with the description serve to explain the principles of the invention. In the drawings:

DETAILED DESCRIPTION OF THE PREFERRED EMBODIMENTS

Reference will now be made in detail to the illustrated embodiments, which are illustrated in the accompanying drawings.

Figure 3:
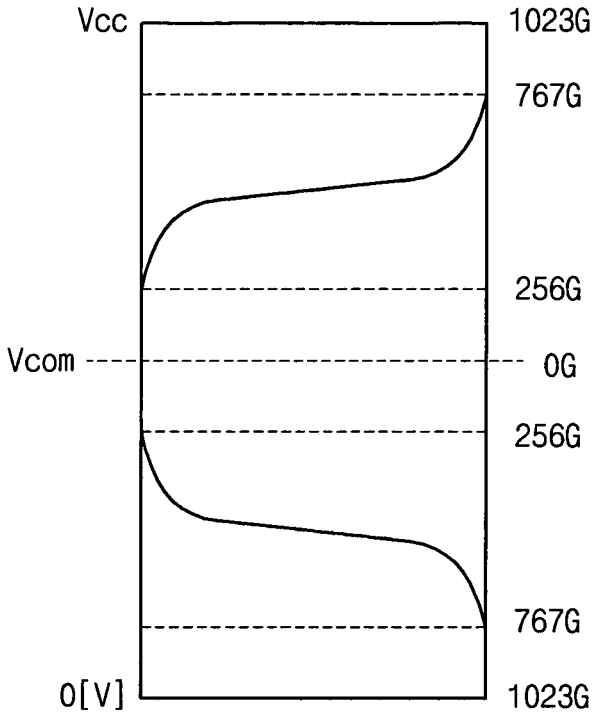
FIG. 3 is a graph illustrating level voltages generated in a data drive IC according to an exemplary embodiment.

FIG. 3 is a graph illustrating level voltages generated in a data drive IC according to an exemplary embodiment. In this exemplary embodiment, an (n+1)-bit data drive IC is used for an over driving of an n-bit data signal. The (n+1)-bit data driver IC generates $2^{(n+1)}$ level voltages. Over driving data voltages are selected among the $2^{(n+1)}$ level voltages. When the n-bit data signal is used to display an image, a number of the level voltages generated is more than a number of the gray levels of the data signal. Accordingly, the over driving can be performed for the entire gray levels.

As shown in FIG. 3, for example, a 10-bit data drive IC is used for an over driving of a 9-bit data signal. The 10-bit data drive IC generates $2^{10}$ (=1024) level voltages 0G to 1023G. More specifically, the 10-bit data drive IC generates $2^{10}$ (=1024) positive level voltages and $2^{10}$ (=1024) negative level voltages, with respect to a common voltage Vcom. The pixel alternately has positive polarity and negative polarity by a frame according to an inversion driving method. For the inversion driving method, the data drive IC generates the positive level voltages and the negative level voltages, which are substantially symmetrical with respect to the common voltage Vcom. When the pixel has positive polarity during a frame, one of the positive level voltages is outputted as an over driving data voltage, and when the pixel has negative polarity during a next frame, one of the negative level voltages is outputted as an over driving data voltage.

Parts of the $2^{10}$ (=1024) level voltages 0G to 1023G are used as available gray level voltages. For example, $257^{th}$ to $768^{th}$ level voltages 256G to 767G may be used as available gray level voltages. The $257^{th}$ to $768^{th}$ level voltages 256G to 767G correspond to $1^{st}$ to $512^{th}$ gray levels of the 9-bit data signal, for example, respectively. For example, the $257^{th}$ to $768^{th}$ level voltages 256G to 767G are pixel voltages normally displaying $1^{st}$ to $512^{th}$ gray levels, respectively. The available gray level voltages may be also over driving data voltages for the $2^{nd}$ to $511^{th}$ gray levels except for a $1^{st}$ gray level and a $512^{th}$ gray level (i.e., lowest and highest gray levels or full dark and full bright gray levels).

One of the $769^{th}$ to $1024^{th}$ level voltages 768G to 1023G may be used as an over driving data voltage for the highest gray level, and one of the $1^{st}$ to $256^{th}$ level voltages 0G to 255G may be used as an over driving data voltage for the lowest gray level.

In the over driving method according to the exemplary embodiment, when a data signal of a present frame has a gray level higher than a data signal of a previous frame, a level voltage higher than a level voltage of the gray level of the present frame is outputted as an over driving data voltage. When a data signal of a present frame has a gray level lower than a data signal of a previous frame, a level voltage lower than a level voltage of the gray level of the present frame is outputted. Even when the data signal of the present frame has a highest or lowest gray level, one of the level voltages higher than the available gray level voltages or one of the level voltage lower than the available gray level voltages may be used as an over driving data voltage for the highest or lowest gray level. Accordingly, the pixel can have the normal voltages desired to display the entire gray levels.

By using the data driver IC having a bit number more than a bit number of the data signal, there are over driving voltages for the entire gray levels including the highest and lowest gray levels. Thus, over driving for the entire gray levels can be performed.

A method of driving the LCD device according to the exemplary embodiment of the present invention is explained in detail with reference to FIGS. 3 and 4.

Figure 4:
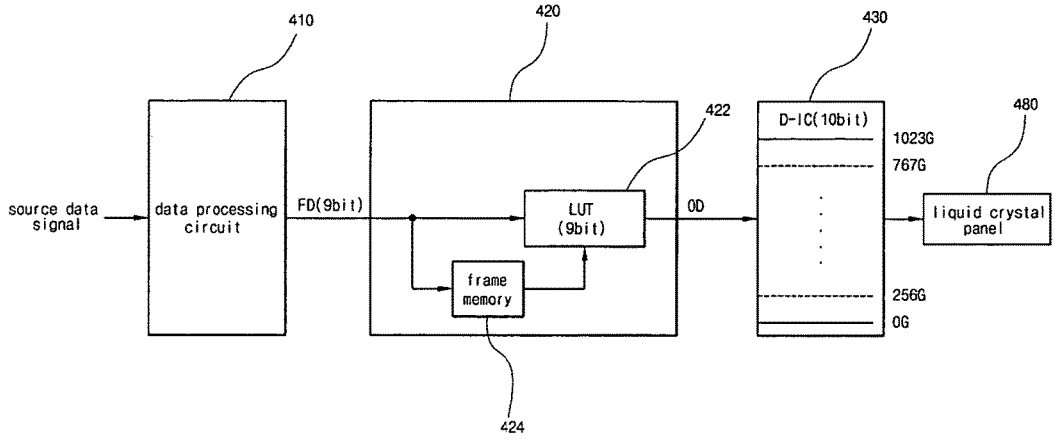
FIG. 4 is a schematic block diagram illustrating an LCD device according to the exemplary embodiment.

FIG. 4 is a schematic block diagram illustrating an LCD device according to the exemplary embodiment. The LCD device according to this exemplary embodiment includes a driving circuit and a liquid crystal panel 480.

Figure 1:
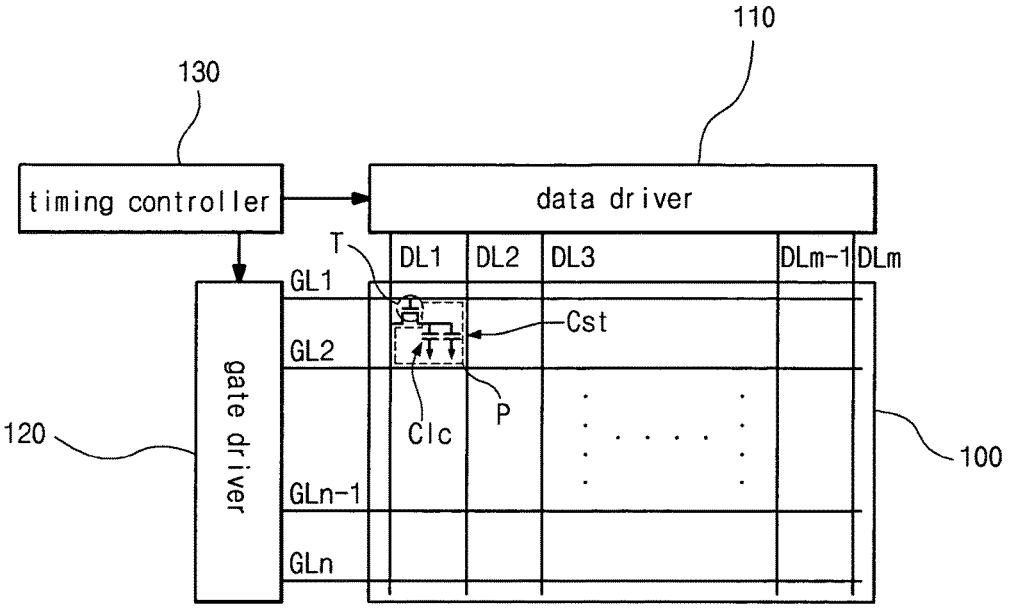
FIG. 1 RELATED ART
FIG. 1 is a schematic view of an LCD device according to the related art.
Figure 2A:
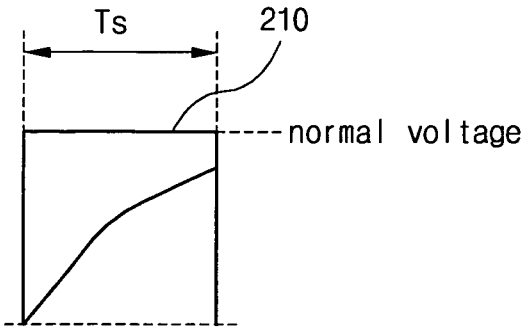
FIG. 2A RELATED ART
FIG. 2 is a waveform illustrating the over driving method of the related art LCD.
Figure 2B:
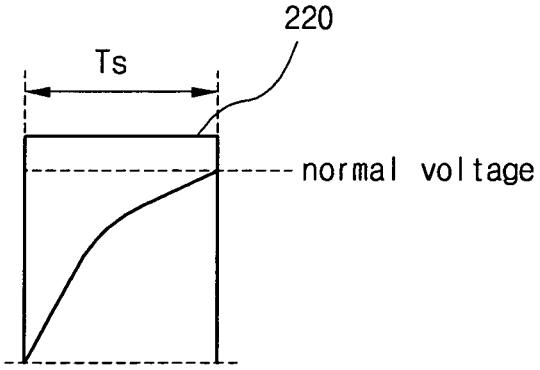
FIG. 2B RELATED ART

The liquid crystal panel 480 is similar to the liquid crystal panel of FIG. 1. Accordingly, detail explanations of the liquid crystal panel 480 are omitted.

The driving circuit includes a data processing circuit 410, an over driving data generator 420, and a data drive IC 430.

The data processing circuit 410 and the over driving data generator 420 may be included in a timing controller (130 of FIG. 1). The data drive IC 430 is included in a data driver (110 of FIG. 1).

The data processing circuit 410 is supplied with a source data signal from an external system. The data processing circuit 410 processes the source data signal to generate a frame data signal FD. The frame data signal is an n-bit data signal, for example, a 9-bit data signal. The frame data signal FD displays 512 gray levels. The source data signal may have a bit number less than a bit number of the frame data signal FD. During data processing, information of the source data signal may be partially lost. Accordingly, the data processing circuit 410 may generate the frame data signal FD having a bit number more than a bit number of the source data signal.

The over driving data generator 420 includes a frame memory 424 and a look-up table (LUT) 422. The frame memory 424 stores a frame data signal of the previous frame. The look-up table 422 is an input-to-output table. The look-up table 422 is supplied with the present frame data signal and the previous frame data signal and outputs an over driving data signal OD according to the comparison of the present frame data signal with the previous frame data signal. For example, the look-up table 422 functions as comparing a gray level of the present frame data signal with a gray level of the previous frame data signal and generating the over driving data signal OD according to the comparing result. When the gray level of the present frame data signal is higher than the gray level of the previous frame data signal, the over driving data signal OD has a level higher than a level (for example, gray level) of the present frame data signal. When the gray level of the present frame data signal is lower than the gray level of the previous frame data signal, the over driving data signal OD has a level lower than a level (for example, gray level) of the present frame data signal.

The over driving data signal OD may has $(2^9+2)$ levels for the 9-bit data signal. The $1^{st}$ level of the over driving data signal OD is for the over driving of the $1^{st}$ gray level of the 9-bit data signal, and the $(2^9+2)^{th}$ level of the over driving data signal OD is for the over driving of the $(2^9)^{th}$ gray level of the 9-bit data signal. The $2^{nd}$ to $(2^9+1)^{th}$ levels of the over driving data signal OD are for the $2^{nd}$ to $(2^9-1)^{th}$ gray levels of the 9-bit data signal.

The over driving data signal OD is inputted to the data drive IC 430. The data drive IC 430 outputs one of the level voltages of the over driving data signal OD. For example, the $2^{nd}$ to $(2^9+1)^{th}$ levels of the over driving data signal OD correspond to $257^{th}$ to $768^{th}$ level voltages 256G to 767G, for example, respectively. The $1^{st}$ level of the over driving data signal corresponds to one of the $1^{st}$ to $256^{th}$ level voltages 0G to 255G. The $(2^9+2)^{th}$ level of the over driving data signal corresponds to one of the $769^{th}$ to $1024^{th}$ level voltages 768G to 1023G. Accordingly, the $257^{th}$ to $768^{th}$ level voltages 256G to 767G, one of the $1^{st}$ to $256^{th}$ level voltages 0G to 255G, and one of the $769^{th}$ to $1024^{th}$ level voltages 768G to 1023G are used as over driving data voltages for the entire gray levels.

One among the $257^{th}$ to $768^{th}$ level voltages 256G to 767G, one of the $1^{st}$ to $256^{th}$ level voltages 0G to 255G, and one of the $769^{th}$ to $1024^{th}$ level voltages 768G to 1023G is outputted as an over driving voltage to the data line in the liquid crystal panel 480. The outputted over driving data voltage is applied to the corresponding pixel of the liquid crystal panel 480. Since the pixel is applied with the over driving data voltage having a level higher or lower than the gray level of the present frame, the pixel has the pixel voltage (normal voltage) desired during the present frame so that the gray level of the present frame is displayed normally.

By using the data driver IC having a bit number more than a bit number of the data signal, over driving for the entire gray levels can be performed. Accordingly, dynamic contrast ratio (C/R) and display quality can be improved.

Figure 5:
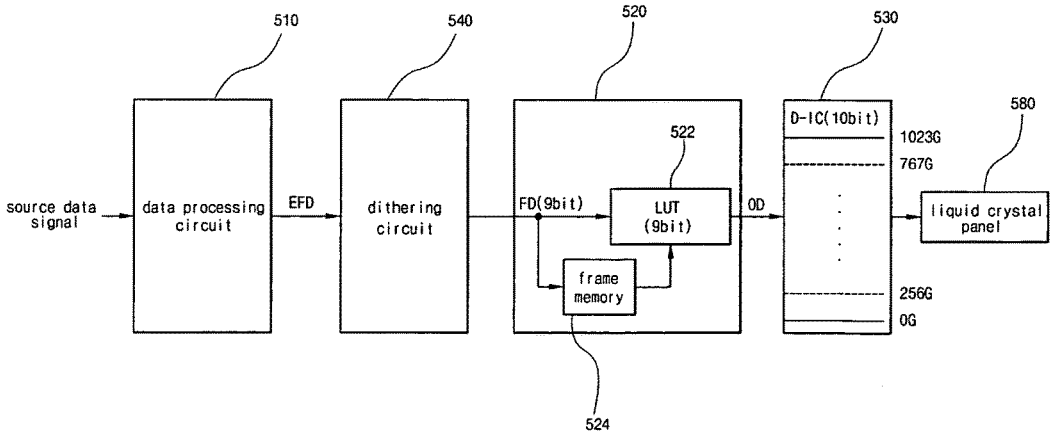
FIG. 5 is a schematic block diagram illustrating an LCD device according to another exemplary embodiment.

FIG. 5 is a schematic block diagram illustrating an LCD device according to another exemplary embodiment. The LCD device of FIG. 5 is similar to that of FIG. 4, except for a dithering circuit. Accordingly, detail explanations of parts similar to parts of FIG. 4 are omitted.

As shown in FIG. 5, the LCD device includes a dithering circuit 540 for a dithering process. The dithering process is used to display more gray levels with a data drive IC realizing an n-bit data signal. For example, even when 29 gray levels are realized by the data drive IC, $2^{(9+k)}$ gray levels can be displayed by the dithering process (k is a natural number).

The dithering circuit 540 is arranged between a data processing circuit 510 and an over driving data generator 520. The data processing circuit 510 generates a (9+k)-bit extended frame data signal EFD. The dithering circuit 540 truncates k low significant bits (LSB) of the extended frame data signal EFD, and generates a plurality of 9-bit frame data signals FD to spatially and/or temporally compensate the truncation of the k low significant bits. The plurality of 9-bit frame data signals FD are repeated during at least one frame so that a gray level between gray levels displayed by the plurality of 9-bit frame data signals FD is perceived by a viewer. The gray level between the gray levels displayed by the plurality of 9-bit frame data signals FD is a gray level, which the (9+k) extended frame data signal EFD displays. The spatial compensation is to apply the frame data signals FD having different gray levels to different pixels to compensate the truncation of the low significant bits. The temporal compensation applies the frame data signals FD having different gray levels during different frames to compensate for the truncation of the low significant bits.

The 9-bit frame data signal FD is inputted to the over driving data generator 520. The over driving data generator 520 compares the present frame data signal with the previous frame data signal to output an over driving data signal OD by using a frame memory 524 and a look-up table 522, for example, as in the embodiment shown in FIG. 4.

A data drive IC 530 outputs the over driving data voltage of the over driving data signal OD to a liquid crystal panel 580, as in the embodiment shown in FIG. 4.

In another exemplary embodiment, by using the data driver IC having a bit number more than a bit number of the data signal, over driving for the entire gray levels can be performed. Accordingly, dynamic contrast ratio (C/R) and display quality can be improved. In this embodiment, by using the dithering circuit, gray levels more than gray levels realized by the data drive IC can be displayed. Accordingly, product cost can be reduced and high performance can be achieved.

It will be apparent to those skilled in the art that various modifications and variations can be made in the liquid crystal display device and the method of driving the display device of the present embodiments without departing from the spirit or scope of the invention. Thus, it is intended that the present invention cover the modifications and variations of this invention provided they come within the scope of the appended claims and their equivalents.

What is claimed is:

1. A liquid crystal display device, comprising:

an over driving data generator comparing a gray level of a data signal of a present frame with a gray level of a data signal of a previous frame to output an over driving data signal, wherein the data signal has a bit number of n to form $2^n$ gray levels of data signal, and the over driving data signal has a level number of $2^n+2$, wherein a $1^{st}$ level of the over driving data signal is for over driving a $1^{st}$ gray level of data signal, $2^{nd}$ to $(2^n+1)^{th}$ levels of the over driving data signal are for over driving $2^{nd}$ to $(2^n-1)^{th}$ gray levels of data signal, and a $(2^n+2)^{th}$ level of the over driving data signal is for over driving a $(2^n)^{th}$ gray level of data signal;

a gate driver that supplies a gate voltage to a gate line;

a (n+1)-bit data drive IC receiving the over driving data signal, and generating level voltages having a number of $2^{n+1}$ such that $(2^n+2)$ level voltages, among the $2^{n+1}$ level voltages, corresponding to the $2^n+2$ levels of the over driving data signal are used as over driving data voltages to be outputted to a data line;

a data processing circuit that generates a (n+k)-bit extended frame data signal;

a dithering circuit that is between the data processing circuit and the over driving data generator, the dithering circuit truncates k low significant bits of the extended frame data signal, and generates a plurality of n-bit frame data signals to spatially or temporally compensate the truncation of the k low significant bits, the plurality of n-bit frame data signals being repeated during at least one frame, the n-bit frame data being input to the over driving data generator, wherein the $2^{n+1}$ level voltages are divided into first, second and third level groups in level order such that the second level group has $2^n$ level voltages between the first and third level groups, the first level group has $2^{n-1}$ level voltages, and the third level group has $2^{n-1}$ level voltages, wherein one of the $2^{n-1}$ level voltages of the first level group is used as an over driving data voltage corresponding to the $(2^n+2)^{th}$ level of the over driving data signal, wherein one of the $2^{n-1}$ level voltages of the third level group is used as an over driving data voltage corresponding to the $1^{st}$ level of the over driving data signal, and wherein the $2^n$ level voltages of the second group are used as available gray level voltages corresponding to the $2^n$ gray levels of data signal and are used as over driving data voltages corresponding to the $2^{nd}$ to $(2^n+1)^{th}$ levels of the over driving data signal; and a liquid crystal panel including a data line, a gate line and a pixel connected to the gate line and the data line, wherein the pixel is applied with the over driving data voltage corresponding to the over driving data signal through the data line.

2. The liquid crystal display device according to claim 1, wherein the over driving data generator includes a frame memory storing the data signal of the previous frame.

3. The liquid crystal display device according to claim 1, wherein the data processing circuit processes and outputs a source data signal to the dithering circuit.

4. The liquid crystal display device according to claim 1, wherein the third level group includes gray level voltages from 1st to $(2^{(n-1)}$th level voltages- and having a number of $2^{(n-1)}$, the second level group includes gray level voltages starting from $(2^{(n-1)}+1)$th level voltage and having a number of $2^n$, and the first level group includes the remaining gray level voltages and having a number of $2^{(n-1)}$.

5. The liquid crystal display device according to claim 1, wherein n is 9.

6. A method of driving a liquid crystal display device, comprising:

comparing a gray level of a data signal of a present frame with a gray level of a data signal of a previous frame to output an over driving data signal using an over driving data generator, wherein the data signal has a bit number of n to form $2^n$ gray levels of data signal, and the over driving data signal has a level number of $2^n+2$, wherein a $1^{st}$ level of the over driving data signal is for over driving a $1^{st}$ gray level of data signal, $2^{nd}$ to $(2^n+1)^{th}$ levels of the over driving data signal are for over driving $2^{nd}$ to $(2n-1)^{th}$ gray levels of data signal, and a $(2^n+2)^{th}$ level of the over driving data signal is for over driving a $(2^n)^{th}$ gray level of data signal;

supplying a gate voltage to a gate line from a gate driver;

outputting the over driving data signal to a (n+1)-bit data drive IC, and generating level voltages having a number of $(2^n+1)$ in the (n+1)-bit data drive IC such that $2^n+2$ level voltages, among the $2^{n+1}$ level voltages, corresponding to the $2^n+2$ levels of the over driving data signal are used as over driving data voltages to be outputted to a data line from the (n+1)-bit data drive IC;

applying the over driving data voltage corresponding to the over driving data signal to a pixel, which is connected to the gate line and the data line, of a liquid crystal panel through the data line;

generating, by a data processing circuit, a (n+k)-bit extended frame data signal; and performing a dithering process using a dithering circuit that is between the processing circuit and the over driving data generator, wherein the dithering circuit truncates k low significant bits of the extended frame data signal, and generates a plurality of n-bit frame data signals to spatially or temporally compensate the truncation of the k low significant bits, the plurality of n-bit frame data signals being repeated during at least one frame, the n-bit frame data being input to the over driving data generator, wherein the $2^{n+1}$ level voltages are divided into first, second and third level groups in level order such that the second level group has $2^n$ level voltages between the first and third level groups, the first level group has $2^{n-1}$ level voltages, and the third level group has $2^{n-1}$ level voltages, wherein one of the $2^{n-1}$ level voltages of the first level group is used as an over driving data voltage corresponding to the $(2^n+2)^{th}$ level of the over driving data signal, wherein one of the $2^{n-1}$ level voltages of the third level group is used as an over driving data voltage corresponding to the $1^{st}$ level of the over driving data signal, and wherein the $2^n$ level voltages of the second group are used as available gray level voltages corresponding to the $2^n$ gray levels of data signal and are used as over driving data voltages corresponding to the $2^{nd}$ to $(2^n+1)^{th}$ levels of the over driving data signal.

7. The method according to claim 6, further comprising storing the data signal of the previous frame.

8. The method according to claim 6, wherein the data processing circuit processes and outputs a source data signal to the dithering circuit.

9. The method according to claim 6, wherein n is 9.

* * * * *